United States Patent [19]

Neff

[11] 4,015,521

[45] Apr. 5, 1977

[54] CHARACTER PRINTING APPARATUS

[75] Inventor: Joseph J. Neff, Pasadena, Calif.

[73] Assignee: Bell & Howell Company, Chicago, Ill.

[22] Filed: Apr. 14, 1975

[21] Appl. No.: 567,589

[52] U.S. Cl. ..... 101/99; 101/110; 101/93.22

[51] Int. Cl.[2] ..... B41J 1/44

[58] Field of Search ..... 101/93.22, 93.24, 93.37, 101/93.43, 93.47, 95, 96, 99, 100, 101, 110; 197/18, 53, 54

[56] References Cited

UNITED STATES PATENTS

| | | | |
|---|---|---|---|
| 2,103,098 | 12/1937 | Slettevold et a. | 101/93.44 |
| 2,853,940 | 9/1958 | Weckenfuss et al. | 101/93 |
| 3,106,889 | 10/1963 | Stemme | 101/93 |
| 3,654,860 | 4/1972 | Speicher et al. | 101/110 |
| 3,731,622 | 5/1973 | Baranoff | 101/110 X |
| 3,771,442 | 11/1973 | Ditman | 101/99 |
| 3,861,302 | 1/1975 | Mizutani et a. | 101/95 X |
| 3,865,030 | 2/1975 | Chida et al. | 101/93.22 |
| 3,874,286 | 4/1975 | Ishikawa | 101/93.18 |
| 3,878,779 | 4/1975 | Clary | 101/99 |

*Primary Examiner*—Edward M. Coven
*Attorney, Agent, or Firm*—Benoit Law Corporation

[57] ABSTRACT

Apparatus for printing characters on a printout surface comprise a shaft having a longitudinal axis, a plurality of curved segments mounted side by side on the shaft for individual angular movement about the axis, each of the segments having a series of character types on an outer curved surface and a distinct first surface feature, such as a projection or a recess, behind each of the character types in an inner curved surface. The segments are also movable toward and away from the printout surface perpendicularly to the mentioned axis. The apparatus further includes equipment for selectively positioning the character types adjacent the printout surface, including devices for individually moving the segments angularly relative to the mentioned axis and for selectively resetting the segments to a rest position. The apparatus further includes equipment for selectively moving the shaft and segments toward and away from the printout surface, including a print hammer structure having a second surface feature for engagement of the segments at the first surface features behind athe selectively positioned character types of the angularly moved segments, and equipment coupled to the hammer structure for actuating the angularly moved segments at the first surface features with the print hammer structure toward the printout surface for a printout of the characters on the selectively positioned character types.

22 Claims, 7 Drawing Figures

CHARACTER PRINTING APPARATUS

BACKGROUND OF THE INVENTION

1. Field of the Invention

The subject invention relates to character printing and, more specifically, to apparatus for printing magnetic ink or other characters on a printout surface.

2. Description of the Prior Art

While the subject invention is in part styled in terms of the printing of magnetic ink characters in magnetic ink character recognition systems (MICR), it is not intended to be so limited. Indeed, many other fields of utility will be readily apparent to those skilled in the art from the subject extensive disclosure.

A typical type of printing apparatus of the kind herein under consideration comprises a plurality of mutually parallel and individually adjustable segments which bear the character types to be printed out. In an effort to facilitate the equipment and its operation, it has been proposed to actuate the adjusted character segments with a common print hammer structure. In practice, this has led to alignment problems in the print-out. Also, existing equipment of that type has been incapable of printing out characters at close mutual spacings. In consequence, it is frequently necessary in the case of bank checks or other papers where space is at a premium, to carry out a character printout in two subsequent printing processes, wherein the first printing process will print, say, every odd-numbered character, while the second printing process will thereafter print every even-numbered character in interdigitated relationship to the odd-numbered characters. This, of course, renders the printing process burdensome, expensive and subject to error.

Existing problems in this area have been greatly aggravated by the advent of electronic character reading and data processing equipment wherein alignment and printing errors can easily have devastating consequences in terms of customer aggravation, loss of computer time, loss of funds through erroneous automated payments of larger amounts than as due, and similar difficulties.

In this context, it is easily seen that difficulties of this type can also impede the operation of calculating equipment, accounting systems, date stamping apparatus and other devices which rely on an accurate printout of characters.

In an effort to reduce at least the alignment problem, it has been proposed to provide a notch behind each character type in each printing segment and to provide a corresponding bar which would enter the notches corresponding to the aligned character types and would thus impede character misalignment during the printing process. In prior-art equipment, this proposal has necessitated the provision of extra print hammer equipment in addition to the locking bar. Moreover, this existing proposal necessitated movement of the printout medium toward and onto the character types, thereby imposing limitations on the system in terms of utility, ease of operation and economy.

SUMMARY OF THE INVENTION

It is a general object of this invention to overcome the above mentioned disadvantages.

It is a more specific object of this invention to provide improved apparatus for printing characters on a printout surface.

It is a particular object of this invention to provide improved character printing apparatus wherein the print hammer and character alignment functions are integrated.

It is a further particular object of this invention to provide improved character printing apparatus capable of printing characters at close mutual spacings.

It is a related object of the invention to provide character printing apparatus with improved resetting facilities guaranteeing a reliable reset of the printing segments after each printout operation.

Other objects of the invention will become apparent in the further course of this disclosure.

From one aspect thereof, the subject invention resides in apparatus for printing characters on a printout surface and, more specifically, resides in the improvement comprising, in combination, a shaft having a longitudinal axis, a plurality of curved segments mounted side by side on said shaft for individual angular movement about said axis, each of said segments having a series of character types on an outer curved surface and a distinct first surface feature behind each of said character types in an inner curved surface, connected to said shaft for mounting said shaft for movement together with said segments toward and away from said printout surface perpendicularly to said axis, means operatively associated with said segments for selectively positioning said character types adjacent said printout surface, said character type positioning means including means for individually moving said segments angularly relative to said axis and for selectively resetting said segments to a rest position, and means operatively associated with said segments for selectively moving said shaft and segments toward and away from said printout surface, said segment moving means including a print hammer structure having a second surface feature constructed for simultaneously engaging said angularly moved segments at their first surface features behind the selectively positioned character types, and means coupled to said hammer structure for actuating said print hammer structure toward said angularly moved segments and said printout surface for a printout of said characters on said selectively positioned character types, said first and second surface features being mutually complementary, said means for individually moving said segments including for each segment an individual actuating rod having a longitudinal axis, means coupled to said actuating rod for selectively moving the actuating rod along said longitudinal axis, means coupled to the particular segment and operatively associated with said actuating rod for translating movement of said actuating rod along said longitudinal axis into angular movement of the particular segment relative to said axis, and means for mounting said actuating rod for angular movement during movement of said segments toward and away from said printout surface, and said translating means including a ratchet teeth structure for each of said segments, and said means for moving said actuating rod including means for moving said actuating rod into engagement with said ratchet teeth structure for angular movement of the particular segment.

From another aspect thereof, the subject invention resides in apparatus for printing characters on a printout surface and, more specifically, resides in the improvement comprising, in combination, a shaft having a longitudinal axis, a plurality of curved segments mounted side by side on said shaft for individual angular movement about said axis, each of said segments having a series of character types on an outer curved surface and a distinct notch behind each of said character types in an inner curved surface, means connected to said shaft for mounting said shaft for movement together with said segments toward and away from said printout surface perpendicularly to said axis, means operatively associated with said segments for selectively positioning said character types adjacent said printout surface, said character type positioning means including means for individually moving said segments angularly relative to said axis and for selectively resetting said segments to a rest position, and means operatively associated with said segments for selectively moving said shaft and segments toward and away from said printout surface, said segment moving means including a print hammer structure constructed for simultaneous entry into the notches behind the selectively positioned character types of said angularly moved segments, and means coupled to said print hammer structure for actuating said print hammer structure toward said angularly moved segments and said printout surface for a printout of the characters on said selectively positioned character types said means for individually moving said segments including for each segment an individual actuating rod having a longitudinal axis, means coupled to said actuating rod for selectively moving the actuating rod along said longitudinal axis, means coupled to the particular segment and operatively associated with said actuating rod for translating movement of said actuating rod along said longitudinal axis into angular movement of the particular segment relative to said axis, and means for mounting said actuating rod for angular movement during movement of said segments toward and away from said printout surface, and said translating means including a ratchet teeth structure for each of said segments, and said means for moving said actuating rod including means for moving said actuating rod into engagement with said ratchet teeth structure for angular movement of the particular segment.

From another aspect thereof, the invention resides in apparatus for printing characters on a printout surface and, more specifically, resides in the improvement comprising, in combination, a shaft having a longitudinal axis a plurality of curved segments mounted side by side on said shaft for individual angular movement about said axis, each of said segments having a series of character types on an outer curved surface, means connected to shaft for mounting said shaft segments for movement together with said segments toward and away from said printout surface perpendicularly to said axis, means connected to said segments for biasing said segments to a rest position, means operatively associated with said segments for selectively positioning said character types adjacent said printout surface, said character type positioning means including means for individually moving said segments angularly against said bias and relative to said axis, first releasable means for retaining said segments in angularly advanced positions against said bias, second releasable means, distinct from said first releasable means, for retaining said segments in angularly advanced positions against said bias, said second releasable means including means for engaging said angularly moved segments and for moving said shaft and engaged segments toward said printout surface for a printout of said positioned character types, means operatively associated with said first releasable means for releasing said first releasable means after engagement of said segments by said engaging means, and means for releasing said second releasable means and for returning said segments in a direction away from said printout surface after movement of said segments toward said printout surface.

From yet another aspect thereof, the subject invention resides in apparatus for printing characters on a printout surface and, more specifically, resides in the improvement comprising, a shaft having a longitudinal axis in combination, a plurality of curved segments mounted side by side on said shaft for individual angular movement about said axis, each of said segments having a series of character types on an outer curved surface, means connected to said shaft for mounting said shaft for movement together with said segments toward and away from said printout surface perpendicularly to said axis, means operatively associated with said segments for selectively positioning said character types adjacent said printout surface and for returning said segments to a rest position, said character type positioning means including an individual actuating rod for each segment, means for mounting said actuating rod for lateral movement during movement of said segments toward and away from said printout surface, means for actuating each rod in a longitudinal direction, and means for translating longitudinal rod movement into angular segment movement, and means for moving said shaft and segments relative to said printout surface and for printing out said positioned character types and said translating means including a ratchet teeth structure for each of said segments, and said means for moving said actuating rod including means for moving said actuating rod into engagement with said ratchet teethstructure for angular movement of the particular segment.

BRIEF DESCRIPTION OF THE DRAWINGS

The invention and its objects will become more readily apparent from the following detailed description of preferred embodiments thereof, illustrated by way of example in the accompanying drawings in which like reference numerals designate like or functionally equivalent parts and, in which.

DESCRIPTION OF PREFERRED EMBODIMENTS

The character printing apparatus 10 shown in FIGS. 1 to 5 has a housing 12 including a base 13 and a top plate 14.

Figure 2:
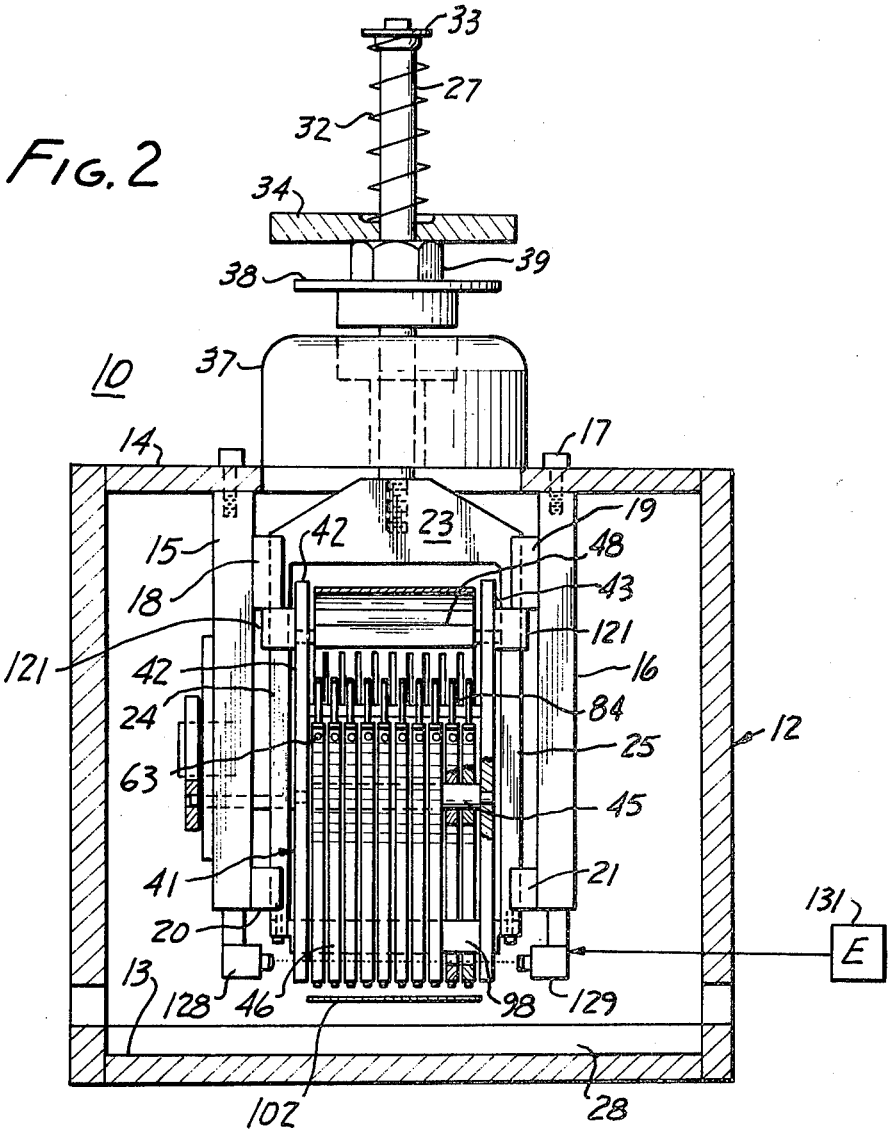
FIG. 2 is a section along the line 2— 2 in FIG. 1.

A pair of support and guide bars 15 and 16 is located in the housing 12 and is attached to the top plate 14 by means of screws, one of which is apparent at 17 in FIG. 2. The bars 15 and 16 carry top guides 18 and 19 and bottom guides 20 and 21. A yoke 23 has legs 24 and 25 slidably disposed in the guide members or linear bearings 18 and 20 and 19 and 21, as seen in FIG. 2.

Figure 5:
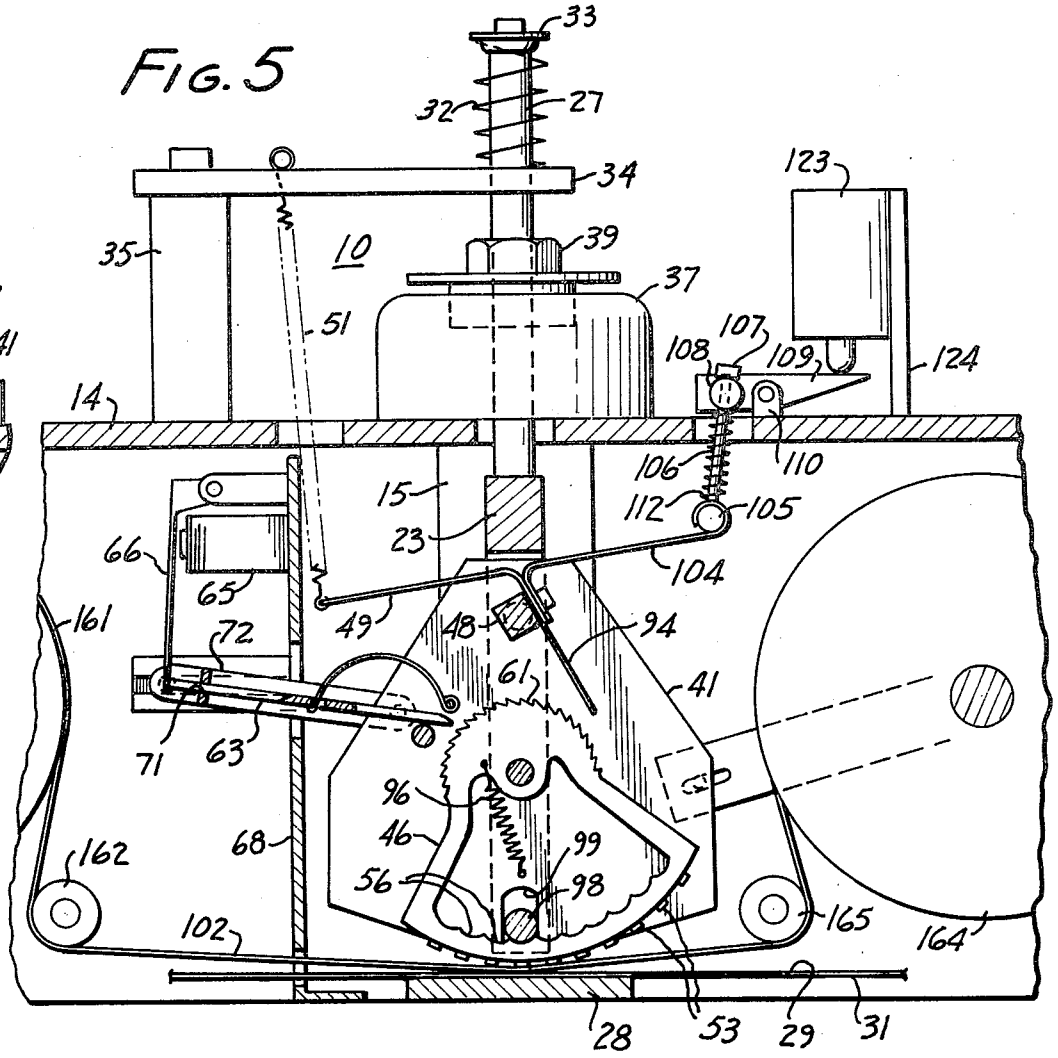
FIG. 5 is a detail view showing the apparatus of FIG. 1 in an active position.

A rod 27 is attached to the yoke 23 and is biased in a direction away from a platen 28 (see FIG. 1) or, in other words, away from the printout surface 29 of a card, check or other printout medium 31 (see FIG. 5). In the illustrated preferred embodiment, this biasing action is performed on the rod 27 by a spring 32 which acts between a flange or plate 33 attached to the free end of the rod 27 and a bracket 34 attached to the top plate 14 via a spacer 35.

A solenoid 37 is attached to the top plate 14 in order to advance the rod 27 against the bias of the spring 32. To this end, the solenoid 37 may have an anchor 38 attached to the rod 27. A stop nut 39 is threaded on the rod 27 and is adjustable thereon by rotation in order to control the throw of the yoke 23.

A print segment carriage 41 has two side plates 42 and 43. The carriage 41 includes a shaft 45 extending between and attached to the side plates 42 and 43 for mounting a set of printing segments 46 side by side and for individual angular movement about the longitudinal axis of the shaft 45.

A further shaft 48, which is of square configuration in the illustrated preferred embodiment, has opposite ends pivoted in the carriage plate 42 and 43. An arm 49 is attached to the square shaft 48 and has a free end engaged by a spring 51 which acts between the bracket 34 and the arm 49 in order to bias the carriage 41 to a rest position away from the platen 28 or printout surface 29. The carriage 41 thus mounts the segments 46 for movement toward and away from the printout surface 29 perpendicularly to the longitudinal axis of the shaft 45.

Each of the segments 46 has a series of character types 53 on an outer curved surface 54 and a distinct notch 56 behind each of the character types 53 in an inner curved surface 57.

In the illustrated preferred embodiment, the segments 46 have a quadrantal configuration. However, the broad aspect of the invention is not so limited, as the segments or elements carrying the character types 53 could for instance, be circular or semicircular or have another desired configuration.

Each segment 46 in the illustrated preferred embodiment has a ratchet teeth structure 61 which permits a selective positioning of the character types 53 adjacent the printout surface 29, for a selection of the various character combinations to be printed by the apparatus 10. Each segment 46 has operatively associated therewith an individual actuating rod 63 for individually moving the segments angularly relative to the longitudinal axis of the shaft 45. Each segment 46 further has an electromagnetic actuator 65 associated therewith. Each of these actuators has an individual anchor 66 which acts on the corresponding rod 63 for an engagement of the corresponding ratchet teeth structure 61 and an angular stepping of the particular segment in accordance with the number of distinct energizations of the particular actuator 65. A mounting plate 68 carries the actuators 65 and is attached to the base plate 13 by a fastener 69.

The ends of the rods 63 adjacent the anchors 66 extend slidably through apertures 71 in a generally U-shaped guide frame 72 which is pivotally mounted on the carriage side plates 42 and 43 by studs 74. The bight portion of the frame 72 is supported by pins 76 which are slidably arranged within guide bars 78 which are attached to the mounting plate 68.

The active ends of the rods 63 adjacent the ratchet teeth structures 61 are loosely supported between crosspins 81 and 82 which extend between and are attached to the carriage side plates 42 and 43.

Each rod 63 has associated therewith an individual bent leaf spring 84 which biases the particular rod 63 and corresponding anchor 66 to a rest position. In the illustrated preferred embodiment, the leaf springs 84 act between the particular rod and the crosspin 82.

Figure 3:
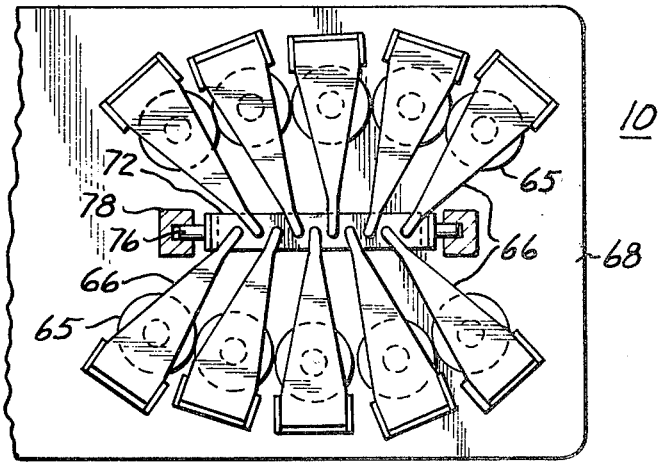
FIG. 3 is a view along the line 3 — 3 in FIG. 1.
Figure 4:
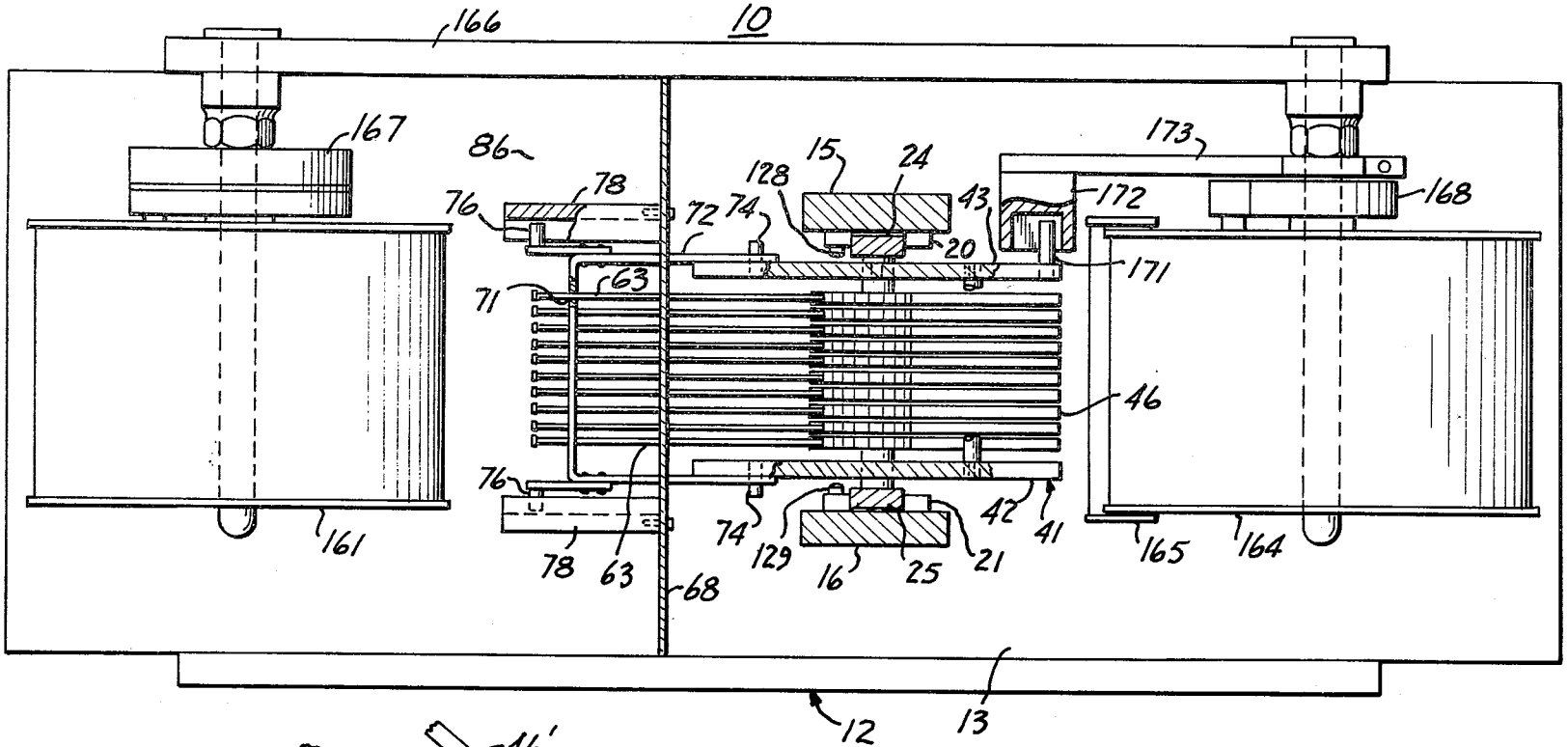
FIG. 4 is a section along the line 4 — 4 in FIG. 1.

It will be noted in FIG. 3 that the longitudinal centerline 86 of the pins 76 passes through the ends of the actuator rods 63 at the anchors 66. In this manner, the acutating rode 63 are mounted for angular movement relative to the longitudinal rod axes in response to movement of the carriage 41 or segments 46 toward and away from the platen 28 or printout surface 29.

A control 91 energizes the actuators 65 via lines 92 so as to set the segments 46 to predetermined angular positions as required for a printout of a desired character combination. The control 91 does not as such form part of the subject invention and may, accordingly, be of a type as conventionally used for the setting and energization of printing equipment of the illustrated kind. For instance, the control 91 may provide one pulse for each step by which a given segment 46 is to be advanced. Pulsing of an actuator 65 will thus result in a corresponding oscillatory movement of its anchor 66 and a corresponding movement of the particular actuating rod 63 which will thus be moved along its longitudinal axis and will engage the ratchet teeth structure 61 at successive teeth. The ratchet teeth structures 61 translate longitudinal movement of each actuator rod 63 into individual angular movement of the corresponding segment 46.

In this manner, the segments are set to their respective angular position for a printout of a predetermined combination of characters.

The square shaft 48 carries detent springs 94 which preferably correspond in number to the segments 46, whereby each segment has its own detent spring. If desired, the individual detent spring may be cut from one plate of spring metal which is then attached to the square shaft 48.

Figure 1:
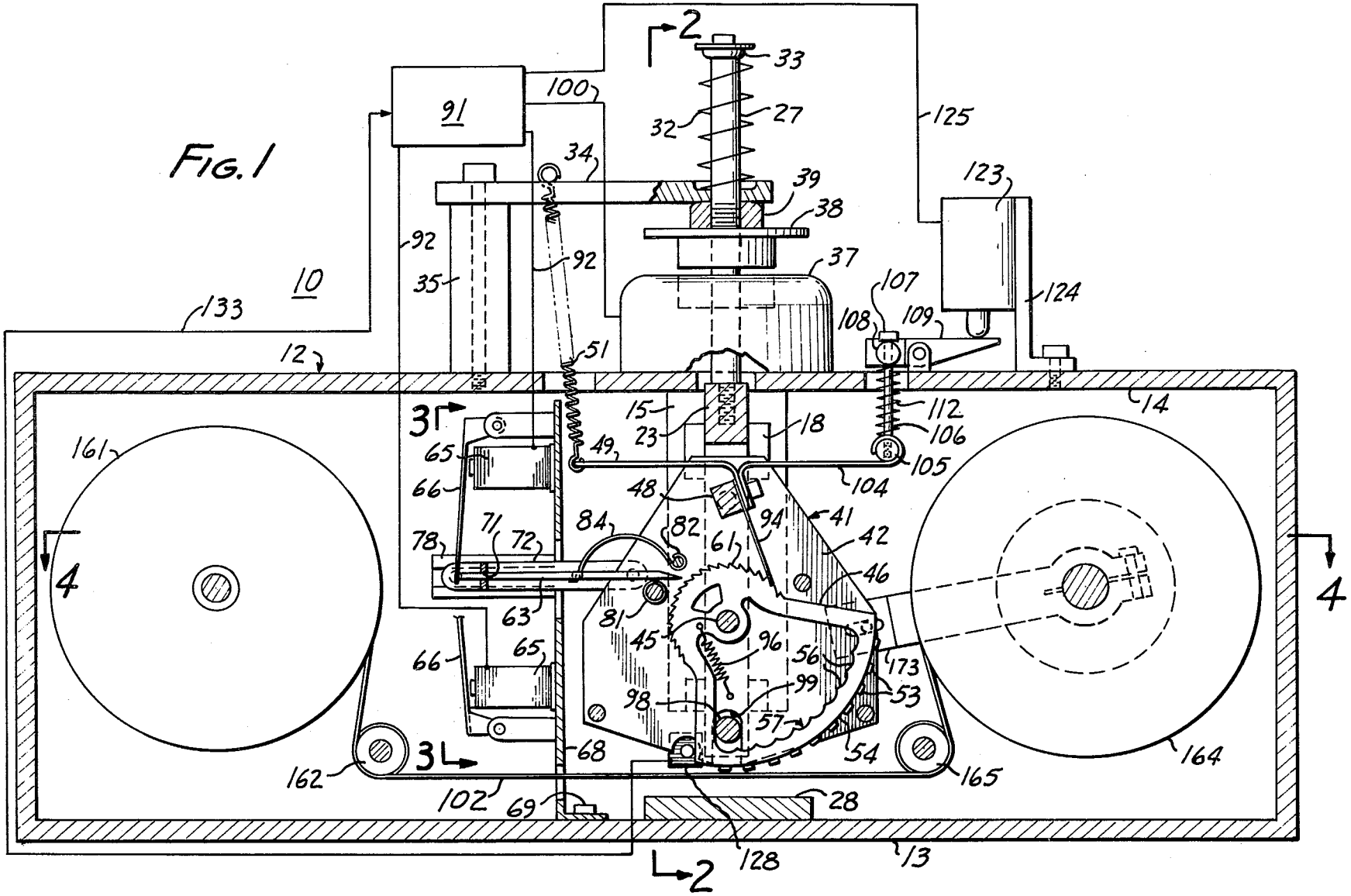
FIG. 1 is a side view, in section, of a printing apparatus in accordance with a preferred embodiment of the subject invention.

In the illustrated preferred embodiment, the longitudinally actuated rods 63 cause the segments 46 to move angularly in a clockwise direction as seen in FIG. 1. The detents 94, in turn, prevent a counterclockwise return of the segments from any advanced position, as long as the detents 94 are biased into engagement with the ratchet teeth structures 61. The detents 94 thus act as releasable means for retaining the segments 46 in angularly advanced positions against the bias of springs 96.

Each segment 46 has a spring 96 associated therewith for a bias of the segment toward a rest position and a resetting of the segment to that rest position upon a release of the detents 94, as more fully described in the further course of this disclosure.

The apparatus 10 has a print hammer structure 98 constructed for simultaneous entry into the notches 56 behind the selectively positioned character types 53 of the angularly moved segments.

In the illustrated preferred embodiments of the invention, the print hammer structure 98 is formed by a crossbar which extends between and is attached to the extreme ends of the legs 24 and 25 of the above mentioned yoke 23.

The yoke 23, the rod 27 and the solenoid 37 with its armature 38 constitute a means, being coupled to the print hammer structure 98, for actuating the angularly moved segments at the entered notches 56 with the print hammer structure 98 toward the platen 28 or printout surface 29 for a printout of the characters on the selectively positioned character types. In a broader sense, the parts just described, as well as the compression or bias spring 32, constitute a means for selectively moving the segments 46 toward and away from the platen 28 or printout surface 29. To permit a certain relative movement between the print hammer structure 98 and the segment carriage 41, a clearance or slot 99 is provided in each of the carriage side plates 24 and 25 at the location of the print hammer structure 98.

In order to effect a printout of a selected or set character combination, the solenoid 38 is energized from the control 91 by an electric current pulse via a line 100. This attracts the anchor 38 to the solenoid proper 37, resulting in compression of the spring 32 and downward movement of the rod 27, yoke 23 and print hammer structure 98.

The print hammer structure 98 thereby enters the notches 56 behind the angularly positioned print characters adjacent the platen 28 or printout surface 29. This has an immediate centering and position retaining action on the selected character types 53.

In contrast to the design and operation of prior-art equipment of the initially mentioned type, this does not exhaust the utility of the equipment according to the subject invention. Rather, the latter centering and position retaining action is quickly followed by a printout action, in that the rod 27, yoke 23 and print hammer structure 98 continue in their travel toward the platen 28 or printout surface 29, whereby the print hammer structure 98 advances the angularly adjusted segments 46 toward the platen 28 and presses the selected character types 53 against the printout surface 29 via an ink ribbon 102. The segment carriage 41 is thereby advanced together with the shaft 45 and segments 46 and against the bias of the spring 51 or of another spring (not shown) which may, for instance, be provided between the carriage 41 and a stationary part, such as one or both of the bars 15 and 16.

The segments 46 are thus advanced by the print hammer structure 98 to the position shown in FIG. 5 for a printout of the angularly adjusted characters 53.

In practice, great care has to be taken in avoiding any misprints, especially in bank checks and similar situations where printing of erroneous amounts could have very severe effects in terms of customer dissatisfaction, slowdown of operations and financial loss.

Various safeguards against such occurrences are herein disclosed in accordance with preferred embodiments of the subject invention.

In particular, it will be noted from FIG. 5 that the detents 94 are disengaged from the ratchet teeth structures 61 in response to movement of the carriage 41 relative to the platen 28 or printout surface 29. The segments 46 are thereby freed from the restraint of the detents 94, preparatory to a resetting of these segments to their initial or rest position by the bias springs 96.

To this end, a segment reset arm 104 is attached to the square shaft 48. A bent end of the arm 104 contains an insert 105 into which an adjustment pin 106 is threaded. The adjustment pin 106 extends through and has a head 107 resting against a lateral projection 108 of a detent trip lever 109 which is pivoted by means of a mounting bracket 110 relative to the top plate 14. A spring 112 extends around the pin 106 and maintains the parts 105 and 108 in mutually spaced relationship.

Function and timing of the detent release may be adjusted by an adjustment of the spacing between parts 105 and 108 through appropriate rotation of the adjustment pin head 107.

The arm 104 angularly moves relative to the insert 105 and the square shaft 48 rotates relative to the carriage 41 as the segments 46 travel toward the printout surface 29. The segments 46 are thereby released from the restraint of the detents 94.

In the illustrated preferred embodiment of the invention, disengagement of the detents 94 from the ratchet teeth structures 61 does not at that instant result in an automatic reset of the segment 46. Rather, the detents 94 with associated equipment constitute only a first releasable means for retaining the segments 46 in angularly advanced positions against the bias of the springs 96. A second releasable means, distinct from the mentioned first releasable means, for retaining the segments 46 in their angularly advanced positions against the mentioned bias is constituted by the print hammer structure 98 with its associated equipment. In particular, the print hammer structre 98, when entering the notches 56 upon energization of the solenoid 37 retains the segments 46 in their angularly advanced positions as long as it remains in engagement with the segments at the notches 66.

The release arm 104 with associated equipment thereby act as a means for releasing the detents 94 or first releasable means after engagement of the segments 46 by the print hammer structure or engaging means 98. On the other hand, the compression spring 32 operates as a means for releasing the print hammer structure 98 or second releasable means and for returning the segments 46 in a direction away from the platen 28 or printout surface 29 after movement of these segments toward the platen 28 or printout surface 29. In particular, after the pulse-like energization of the solenoid 37 for the execution of a printing stroke by the hammer structure 98 has stopped, the compression spring 32 is able to move the rod 27, yoke 23 and print hammer structure 98 away from the platen 28 or printout surface 29.

In this manner, the carriage 41 and the segments 46 will also be returned to their rest position shown in FIG. 1, such as by means of the bias provided by the spring 51 or by another spring (not shown) which may be provided between the carriage 41 and the top plate 14, for instance. Guides 121 may be provided on the carriage 41 as shown in FIG. 2, and may ride along part of the legs 24 and 25 of the yoke 23 to facilitate movement of the carriage 41 relative to the yoke 23.

The preferred embodiment shown in FIGS. 1 to 5 includes a solenoid 123 which is mounted on the top plate 14 by a bracket 124 for the purpose of tripping the detent release lever 109 in response to energization from the control 91 via a line 125. When energized, the solenoid 123 assures that all segments 46 will be in their initial or rest position shown in FIG. 1 before the next printing operation commences.

Accordingly, the control 91 may routinely energize the solenoid 123 at the end of each printing operation to make sure that all segments are reset. In maximum security or reliability situations, an additional feature may be employed in accordance with yet another preferred embodiment.

In particular, a photocell or other sensor 128 may be employed to detect any resetting failure of a character segment. As shown in FIG. 2, the photocell 128 is illuminated by a light source 129 which is electrically energized from a power source 131. The light source 129 projects a beam of light across the segment assembly in the carriage 41, essentially in parallel to the longitudinal axis of the shaft 45.

The control 91 determines at the end of a printing operation whether the photocell 128 is supplying a signal via a line 133. If the beam emitted by the light source 129 is not obstructed by any segment, then the photocell 128 will provide the control 91 with an electric signal via line 133. On the other hand, the photocell 128 will not be able to develop such an illumination responsive signal if the beam issued by the light source 129 is obstructed by any segment that has failed to reset because breakage of the spring 96, malfunction of the detent 94 or for any other reason. In that case, the control 91 will determine at the end of a printing operation that the signal from the photocell 128 is not forthcoming. In that case, the control may take any action appropriate to the occasion, such as a shutting down of the printing operation, the release of an alarm or any combination of these and other measures.

On the other hand, the feature involving the solenoid 123 is not always necessary in practice. In those cases, the solenoid 123 may be deleted and the trip bar or lever 109 may be replaced by a bracket 141 attached to the top plate 14. The part 108 is then a projection of the bracket 141 and the release of the advanced segments 46 then depends on the automatic release provided in response to movement of the segment carriage 41 relative to the platen 28 and printout surface 29.

In some practical applications, the automatic reset of the segments 46 may be improved by an imposition of a predetermined time delay on the movement of the detents 94 or other temporary segment retaining means.

Figure 6:
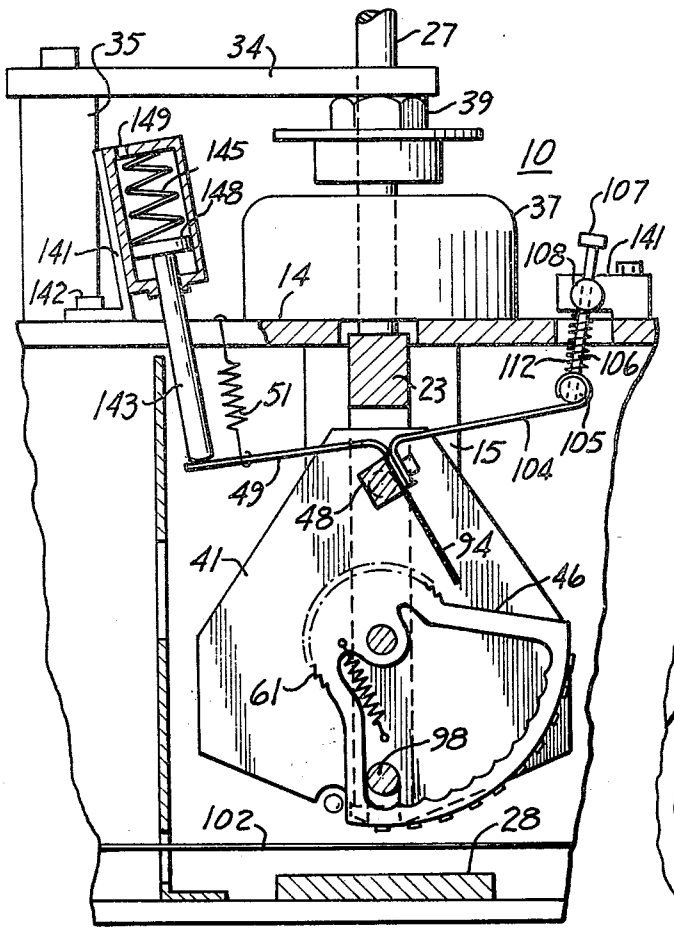
FIG. 6 is a view similar to FIG. 5 showing a modification of the apparatus of FIG. 1 in accordance with a further preferred embodiment of the subject invention.

For instance, and as shown in FIG. 6, a dashpot 141 may be mounted by a bracket 142 on the top plate 14 and may have a plunger 143 in contact with the lever arm 49. The spring 51 now provided between the top plate 14 and the lever arm 49, is stretched when the carriage 41 is moved into the direction of the printout surface 29 as described above. In that case, a spring 145 in the dashpot 141 is able to move the plunger 143 so that it follows the downwardly moving lever arm 49.

When the carriage 41 returns to its initial or rest position at the conclusion of a printing operation, the lever 49 will be restrained by the dashpot plunger 43 from immediately assuming its rest position. In particular, a piston 148 will have to displace a volume of air through an orifice 149 in the dashpot 141 before the lever arm 49 can resume its rest position. In practice, this imposes a delay on the return of the disengaged detent 94 to its rest position in engagement with the ratchet teeth structures 61 of the segments 46. It will be recalled at this juncture that the detents 94 are automatically disengaged in the course of a printing cycle as mentioned above.

The latter delay will assure that the detents 94 are still disengaged when the returning print hammer structure 98 leaves the notches 56 of the segments 46 upon a return of the carriage 41 to its initial or rest position shown in FIG. 1 This is apparent from FIG. 6 which illustrates the condition of the printing apparatus after an effected printout and return of the yoke 23 and carriage 41 to their rest positions. If desired, the spring 51 may be deleted and its function performed by the spring 112 which, as seen in FIG. 6, is compressed whereby the pin 106 will temporarily slide outwardly in the member 108.

In this manner, there is sufficient assurance for most practical situations that the detents 94 will only reengage the ratchet teeth structures 61 after all segments have been completely reset by the bias springs 96.

In the illustrated preferred embodiment, the print hammer structure 98 has a convex circular cylindrical surface and each of the notches 56 has a concave surface congruent with at least part of the cylindrical print hammer surface. While this is presently believed to be the optimum configuration, it should be understood that the invention extends broadly to structures wherein the inner curved surface 58 of each segment 46 has a distinct first surface feature behind each of the character types 53. In that case, the print hammer structure has a second surface feature constructed for simultaneously engaging the angularly moved segments 46 at their first surface features behind the selectively positioned character types. In that case, the first and second surface features are mutually complementary.

Figure 7:
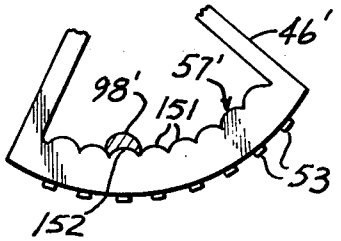
FIG. 7 is a detail view of a modification of the apparatus of FIG. 1 in accordance with yet another preferred embodiment of the subject invention.

A further example of the latter broadly expressed concept is apparent form FIG. 7 which shows a segment 46' that may have the same configuration as the above mentioned segments 46, except that its inner curved surface 57' is provided with protrusions or projections 151 rather than with the above mentioned notches 56. In that case, the print hammer structure 98 is replaced by a print hammer structure 98' which has a notch or recess 152 that is congruent with at least part of each projection 151.

As seen in FIG. 7, the projections 151 may be convex and the recess 152 may be concave.

The printing ribbon 102 employed in the apparatus 10 may be of a magnetic ink or any other suitable type, being supplied from a supply reel 161 via a roller 162 and being taken up by a takeup reel 164 via a roller 165. The supply reel 161 may be mounted on a frame member 166 via a brake clutch 167 which prevents excessive unwinding of the ribbon 102 from the reel 161.

The takeup reel 164 is mounted on the frame member 166 via a one-way clutch 168. Downward or printing motion of the carriage 41 actuates the clutch 164 via a pin 171 attached to the carriage 41 and a slotted follower member 172 attached to an increment advance lever 173 of the one way clutch 168. In this manner, a predetermined relative movement of the carriage 41 in the course of a printing operation advances the ink ribbon 102 by a predetermined increment to assure a full and clear printout of each selected character combination. This is particularly important in cases where the printed-out characters are subsequently subjected to a machine type reading operation, such as a magnetic ink character recognition process.

The subject extensive disclosure will suggest or render apparent various modifications and variations within the spirit and scope of the invention to those skilled in the art.

I claim:

1. In apparatus for printing characters on a printout surface, the improvement comprising in combination:

a shaft having a longitudinal axis;

a plurality of curved segments mounted side by side on said shaft for individual angular movement about said axis, each of said segments having a series of character types on an outer curved surface and a distinct first surface feature behind each of said character types in an inner curved surface;

means connected to said shaft for mounting said shaft for movement together with said segments toward and away from said printout surface perpendicularly to said axis;

means operatively associated with said segments for selectively positioning said character types adjacent said printout surface, said character type positioning means including means for individually moving said segments angularly relative to said axis and for selectively resetting said segments to a rest position; and means operatively associated with said segments for selectively moving said shaft and segments toward and away from said printout surface, said segment moving means including a print hammer structure having a second surface feature constructed for simultaneously engaging said angularly moved segments at their first surface features behind the selectively positioned character types, and means coupled to said hammer structure for actuating said print hammer structure toward said angularly moved segments and said printout surface for a printout of said characters on said selectively positioned character types, said first and second surface features being mutually complementary;

said means for individually moving said segments including for each segment an individual actuating rod having a longitudinal axis, means coupled to said actuating rod for selectively moving the actuating rod along said longitudinal axis, means coupled to the particular segment and operatively associated with said actuating rod for translating movement of said actuating rod along said longitudinal axis into angular movement of the particular segment relative to said axis, and means for mounting said actuating rod for angular movement during movement of said segments toward and away from said printout surface; and said translating means including a ratchet teeth structure for each of said segments, and said means for moving said actuating rod including means for moving said actuating rod into engagement with said ratchet teeth structure for angular movement of the particular segment.

2. Apparatus as claimed in claim 1, wherein:

said first surface feature comprises a projection; and said second surface feature comprises a recess congruent with at least part of said projection.

3. Apparatus as claimed in claim 1, wherein:

said first surface feature comprises a convex projection; and said second surface feature comprises a concave recess congruent with at least part of said projection.

4. Apparatus as claimed in claim 1, wherein:

said first surface feature comprises a recess; and said second surface feature comprises a shape congruent with at least part of said recess.

5. Apparatus as claimed in claim 1, wherein: said first surface feature comprises a concave recess; and said second surface feature comprises a convex shape congruent with at least part of said recess.

6. Apparatus as claimed in claim 1, wherein:

said means for individually moving said segments include actuator rods, means for mounting said actuator rods for angular movement relative to a longitudinal axis in response to movement of said segments toward and away from said printout surface, means for individually moving each of said actuator rods along a longitudinal axis, and means for translating longitudinal movement of each actuator rod into individual angular movement of a corresponding segment.

7. In apparatus for printing characters on a printout surface, the improvement comprising in combination:

a shaft having a longitudinal axis;

a plurality of curved segments mounted side by side on said shaft for individual angular movement about said axis, each of said segments having a series of character types on an outer curved surface and a distinct first surface feature behind each of said character types in an inner curved surface;

means connected to said shaft for mounting said shaft for movement together with said segments toward and away from said printout surface perpendicularly to said axis;

means operatively associated with said segments for selectively positioning said character types adjacent said printout surface, said character type positioning means including means for individually moving said segments angularly relative to said axis and for selectively resetting said segments to a rest position;

means operatively associated with said segments for selectively moving said shaft and segments toward and away from said printout surface, said segment moving means including a print hammer structure having a second surface feature constructed for simultaneously engaging said angularly moved segments at their first surface features behind the selectively positioned. character types, and means coupled to said hammer structure for actuating said print hammer structure toward said angularly moved segments and said printout surface for a printout of said characters on said selectively positioned character types, said first and second surface features being mutually complementary; and said resetting means including means for biasing said segments toward a rest position, releasable means for retaining said segments in angularly advanced positions against said bias, and means connected to said releasable retaining means and said means for selectively moving said segments toward and away from said printout surface for releasing said retaining means in response to movement of said segments relative to said printout surface for a release of said segments to said rest position.

8. Apparatus as claimed in claim 7, wherein:

said resetting means include means for imposing a predetermined time delay on movement of said retaining means.

9. In apparatus for printing characters on a printout surface, the improvement comprising in combination:

a shaft having a longitudinal axis;

a plurality of curved segments mounted side by side on said shaft for individual angular movement about said axis, each of said segments having a series of character types on an outer curved surface and a distinct first surface feature behind each of said character types in an inner curved surface;

means connected to said shaft for mounting said shaft for movement together with said segments toward and away from said printout surface perpendicularly to said axis;

means operatively associated with said segments for selectively positioning said character types adjacent said printout surface, said character type positioning means including means for individually moving said segments angularly relative to said axis and for selectively resetting said segments to a rest position;

means operatively associated with said segments for selectively moving said shaft and segments toward and away from said printout surface, said segment moving means including a print hammer structure having a second surface feature constructed for simultaneoulsy engaging said angularly moved segments at their first surface features behind the selectively positioned character types, and means coupled to said hammer structure for actuating said print hammer structure toward said angularly moved segments and said printout surface for a printout of said characters on said selectively positioned character types, said first and second surface features being mutually complementary; and said resetting means including means for biasing said segments toward a rest position, releasable means for retaining said segments in angularly advanced positions against said bias, and selectively actuable electromechanical means for releasing said retaining means for a release of said segments to said rest position.

10. In apparatus for printing characters on a printout surface, the improvement comprising in combination:

a shaft having a longitudinal axis;

a plurality of curved segments mounted side by side on said shaft for individual angular movement about said axis, each of said segments having a series of character types on an outer curved surface and a distinct notch behind each of said character types in an inner curved surface;

means connected to said shaft for mounting said shaft for movement together with said segments toward and away from said printout surface perpendicularly to said axis;

means operatively associated with said segments for selectively positioning said character types adjacent said printout surface, said character type positioning means include means for individually moving said segments angularly relative to said axis and for selectively resetting said segments to a rest position; and means operatively associated with said segments for selectively moving said shaft and segments toward and away from said printout surface, said segment moving means including a print hammer structure constructed for simultaneous entry into the notches behind the selectively positioned character types of said angularly moved segments, and means coupled to said print hammer structure for actuating said print hammer structure toward said angularly moved segments and said printout surface for a printout of the characters on said selectively positioned charcter types;

said means for individually moving said segments including for each segment an individual actuating rod having a longitudinal axis, means coupled to said actuating rod for selectively moving the actuating rod along said longitudinal axis, means coupled to the particular segment and operatively associated with said actuating rod for translating movement of said actuating rod along said longitudinal axis into angular movement of the particular segment relative to said axis, and means for mounting said actuating rod for angular movement during movement of said segments toward and away from said printout surface; and said translating means including a ratchet teeth structure for each of said segments, and said means for moving said actuating rod including means for moving said actuating rod into engagement with said ratchet teeth structure for angular movement of the particular segment.

11. Apparatus as claimed in claim 10, wherein:

said print hammer has a convex cylindrical surface; and each of said notches has a concave surface congruent with at least part of said cylindrical surface.

12. Apparatus as claimed in claim 11, wherein:

said convex surface is circular cylindrical.

13. In apparatus for printing characters on a printout surface, the improvement comprising in combination:

a shaft having a longitudinal axis;

a plurality of curved segments mounted side by side on said shaft for individual angular movement about said axis, each of said segments having a series of character types on an outer curved surface;

means connected to said shaft for mounting said shaft for movement together with said segments toward and away from said printout surface perpendicularly to said axis;

means connected to said segments for biasing said segments to rest position;

means operatively associated with said segments for selectively positioning said character types adjacent said printout surface, said character type positioning means including means for individually moving said segments angularly against said bias and relative to said axis;

first releasable means for retaining said segments in angularly advanced positions against said bias;

second releasable means, distinct from said first releasable means, for retaining said segments in angularly advanced positions against said bias, said second releasable means including means for engaging said angularly moved segments and for moving said shaft and engaged segments toward said printout surface for a printout of said positioned character types;

means operatively associated with said first releasable means for releasing said first releasable means after engagement of said segments by said engaging means; and means for releasing said second releasable means and for returning said segments in a direction away from said printout surface after movement of said segments toward said printout surface.

14. Apparatus as claimed in claim 13, wherein:

said segment engaging means include a print hammer structure for pressing said angularly moved segments against said printout surface.

15. Apparatus as claimed in claim 14, wherein:

each of said segments has a distinct notch behind each of said character types in an inner curved surface; and said print hammer structure is constructed for simultaneous entry into the notches behind the selectively positioned character types.

16. Apparatus as claimed in claim 14, wherein:

each of said segments has a distinct protrusion behind each of said character types in an inner curved surface; and said print hammer structure is constructed for simultaneous engagement of the protrusions behind the selectively positioned character types.

17. Apparatus as claimed in claim 13, wherein:

said means for releasing said first releasable means include means for sensing movement of said segments toward said printout surface and means connected to said sensing means for releasing said first releasable means in response to said movement toward said printout surface.

18. Apparatus as claimed in claim 17, including:

timing delay means connected to said first releasable means for imposing a predetermined time delay on a movement of said first releasable means.

19. Apparatus as claimed in claim 13, including:

electromechnaical means for selectively operating said first releasable means.

20. Apparatus as claimed in claim 13, wherein:

said means for individually moving said segments include for each segment an individual actuating rod having a longitudinal axis, means coupled to said actuating rod for selectively moving the actuating rod along said longitudinal axis, means coupled to the particular segment and operatively associated with said actuating rod for translating movement of said acutating rod along said longitudinal axis into angular movement of the particular segment relative to said axis, and means for mounting said actuating rod for angular movement during movement of said segments toward and away from said printout surface.

21. Apparatus as claimed in claim 20, wherein:

said translating means include a ratchet teeth structure for each of said segments, and said means for moving said actuating rod include means for moving said actuating rod into engagement with said ratchet teeth structure for angular movement of the particular segment.

22. Apparatus as claimed in claim 13, wherein:

said means for individually moving said segments include actuator rods, means for mounting said actuator rods for angular movement relative to a longitudinal axis in response to movement of said segments toward and away from said printout surface, means for individually moving each of said actuator rods along a longitudinal axis, and means for translating longitudinal movement of each actuator rod into individual angular movement of a corresponding segment.

* * * * *